US007874168B2

(12) United States Patent
Cohen et al.

(10) Patent No.: US 7,874,168 B2
(45) Date of Patent: Jan. 25, 2011

(54) MODULAR REFRIGERATION UNIT AND PROCESS FOR ASSEMBLING A MODULAR REFRIGERATION UNIT TO A CABINET OF A REFRIGERATION APPLIANCE

(75) Inventors: Ilan Cohen, Conegliano (IT); Per Wennerström, Knivsta (SE); Xavier Hue, Orsago (IT); Per Fonser, Stockholm (SE)

(73) Assignee: Electrolux Home Products Corporation N.V., Zaventem (BE)

( * ) Notice: Subject to any disclaimer, the term of this patent is extended or adjusted under 35 U.S.C. 154(b) by 526 days.

(21) Appl. No.: 11/813,570

(22) PCT Filed: Dec. 27, 2005

(86) PCT No.: PCT/EP2005/057182

§ 371 (c)(1),
(2), (4) Date: Jun. 17, 2008

(87) PCT Pub. No.: WO2006/074862

PCT Pub. Date: Jul. 20, 2006

(65) Prior Publication Data

US 2009/0000316 A1 Jan. 1, 2009

(30) Foreign Application Priority Data

Jan. 14, 2005 (EP) ..... 05100223

(51) Int. Cl.
*F25B 45/00* (2006.01)

(52) U.S. Cl. ..... 62/77; 62/298; 62/498

(58) Field of Classification Search ..... 62/77, 62/291, 298, 259.1, 440, 454, 498; 312/401, 312/405.1, 406
See application file for complete search history.

(56) References Cited

U.S. PATENT DOCUMENTS

| | | | | |
|---|---|---|---|---|
| 3,650,122 | A * | 3/1972 | Lieberman | 62/298 |
| 4,509,339 | A | 4/1985 | Mehlan et al. | |
| 5,374,118 | A * | 12/1994 | Kruck et al. | 312/407 |
| 5,544,572 | A * | 8/1996 | Garmendia | 99/489 |
| 5,669,221 | A * | 9/1997 | LeBleu et al. | 62/92 |
| 5,678,421 | A * | 10/1997 | Maynard et al. | 62/407 |
| 5,953,929 | A * | 9/1999 | Bauman et al. | 62/259.1 |
| 6,182,453 | B1 * | 2/2001 | Forsberg | 62/125 |

(Continued)

FOREIGN PATENT DOCUMENTS

DE 1601935 1/1971

(Continued)

*Primary Examiner*—Mohammad M Ali
(74) *Attorney, Agent, or Firm*—Pearne & Gordon LLP

(57) ABSTRACT

The present invention relates to a modular refrigeration unit for a refrigeration appliance, and to a process for assembling the modular refrigeration unit to a cabinet of a refrigeration appliance. A modular refrigeration unit (3) includes a base plate (6) supporting a condensing assembly (7), which comprises condensing means (8) and a compressor (9), and an evaporating assembly (10) comprising an evaporator (11); the condensing assembly and the evaporating assembly are operatively interconnected. The evaporating assembly (10) is arranged, in use, vertically spaced apart and above the compressor (9); the evaporating assembly (10) is supported by support means (24) vertically extending from the base plate (6); insulating means (16) separate the evaporating assembly (10) from the condensing assembly (7, 107).

15 Claims, 12 Drawing Sheets

U.S. PATENT DOCUMENTS

| | | | | |
|---|---|---|---|---|
| 6,378,324 | B1 * | 4/2002 | Percy et al. | 62/448 |
| 6,519,970 | B1 * | 2/2003 | Rafalovich et al. | 62/448 |
| 6,701,739 | B2 * | 3/2004 | Morse | 62/277 |
| 2003/0029178 | A1 * | 2/2003 | Zentner et al. | 62/186 |
| 2003/0056526 | A1 * | 3/2003 | Holmes et al. | 62/156 |
| 2003/0080661 | A1 * | 5/2003 | Ahmed et al. | 312/405.1 |
| 2003/0090890 | A1 * | 5/2003 | Miozza et al. | 362/92 |
| 2004/0003617 | A1 * | 1/2004 | Chandler et al. | 62/256 |
| 2004/0134221 | A1 * | 7/2004 | Fee et al. | 62/448 |
| 2004/0231339 | A1 * | 11/2004 | Miozza et al. | 62/3.2 |
| 2004/0237568 | A1 * | 12/2004 | Devos | 62/351 |
| 2004/0263037 | A1 * | 12/2004 | Ritchie et al. | 312/405.1 |

FOREIGN PATENT DOCUMENTS

| | | |
|---|---|---|
| GB | 1176986 | 1/1970 |
| GB | 2227302 | 7/1990 |
| JP | 04227454 | 7/1992 |

* cited by examiner

MODULAR REFRIGERATION UNIT AND PROCESS FOR ASSEMBLING A MODULAR REFRIGERATION UNIT TO A CABINET OF A REFRIGERATION APPLIANCE

The present invention relates to a modular refrigeration unit for a refrigeration appliance, in particular a refrigerator or a freezer for household appliance, and to a process for assembling the modular refrigeration unit to a cabinet of a refrigeration appliance.

Modular refrigeration units are generally known in the field of refrigerated vending machines for snacks or cold beverages; such units generally comprise a common base wherein the compressor, the condenser and the evaporator, including the related conduits and electrical connections, are mounted to form a unitary structure which can be slidingly inserted into the cabinet of the vending machine in a removable manner. The modular refrigeration unit can thus be easily removable from the cabinet for maintenance or in the event of a component failure.

U.S. Pat. No. 5,953,929 discloses a refrigeration system which includes a base having an inlet opening, an evaporator pan, a condenser pan and a compressor mounting surface all integrally formed therein. All of the components of the refrigeration system mount onto the base to form a unitary structure. An evaporator is mounted to the base above the evaporator pan; a condenser is mounted to the base above the condenser pan; a compressor is mounted to the compressor mounting surface and is operatively connected to the evaporator and the condenser. A cover encloses the inlet opening, outlet opening and the evaporator; the cover and the base include an integral locking mechanism to secure the cover to the base. The refrigeration unit, which mounts on top of a refrigerator/freezing cabinet, can be pre-assembled separately from the cabinet and mounted on it either before, after or during assembly of the cabinet.

U.S. Pat. No. 6,701,739 discloses a similar construction for a modular refrigeration system removably installed on top of a cabinet of a refrigeration appliance, such as a vending machine, a refrigerator or a freezer. The refrigeration system can be slid into and out of the appliance so that it can be removed and replaced for maintenance or in the event of a component failure.

A drawback of the known solutions discussed above resides in the fact that all the components of the modular refrigeration unit are supported by a common base which is mounted on top, or at the bottom, of a cabinet; thus the overall dimensions of the refrigeration appliance are greater than that of a conventional refrigerator, in particular for domestic use; this entails that a larger space is needed to house the refrigerator in a furniture assembly of a kitchen, which sometime could be a problem because of the substantially standard sizes of the furnitures. In order to maintain the overall dimensions of the refrigerator within a standard range, the height of the cabinet should be decreased, with the consequence that the internal volume, and therefore the storing capacity of the refrigerator, is reduced.

Another drawback connected with the mounting of the refrigeration unit at the top of the cabinet is that the walls of the cabinet have to be reinforced to be able to support the weight of the unit; in fact this latter houses on its base the heaviest components of the refrigeration system, such as the compressor, the evaporator and the condenser; this aspect becomes particularly critical with conventional refrigerators for household appliances, wherein the outer liner of the cabinet is formed by thin metal panels.

Yet another drawback of the prior art solutions is the difficulty to achieve an effective air-tight insulation between the refrigeration unit and the refrigeration appliance, in particular at the interface between the cabinet and the unit; in fact the known solutions discussed above provide for the air-tight insulation of the evaporating assembly in respect to the condensing assembly, including the compressor and the condenser, by means of an insulated cover which encloses and separates the evaporating portion from the condensing portion. However the problem of insulation at the interface between the cabinet and the refrigeration unit is not solved. Lack or poor insulation at this region can have as a consequence that moisture can penetrate in between the cabinet and the unit causing ice formations which can bring to a significant decrease in the refrigeration performance. This problem is increased by the fact that most of the known refrigeration units in the prior art have to be slidably insertable into and removable out of the cabinet for maintenance or repair; the insulating means, if provided, are then subjected to friction and wear, such that their effectiveness is seriously compromised in the long term.

As a partial solution to the problem of insulation, published patent application U.S. 2004/0134221 discloses a modular refrigeration unit which can be slidably and removably installed on top or at the bottom of a refrigerator; the unit is provided with a bulkhead assembly positioned between the condenser assembly and the evaporator assembly. The refrigeration cabinet includes a condenser chamber adapted for receiving the condenser assembly, which is provided with an insulated wall portion having a mating surface thereon. The refrigeration cabinet also has an insulated main chamber, in which air is cooled by the evaporator assembly. The bulkhead assembly is engageable with the mating surface to form a substantially air-tight seal between the condenser chamber and the main chamber. The bulkhead assembly includes a bulkhead body portion and a gasket assembly, which can include a thermal breaker portion, positioned around the periphery of the bulkhead body portion; the gasket assembly is adapted for engaging with the mating surfaces to seal the condenser chamber from the main chamber.

Even though this known solution tries to solve the above said problem of insulation at the interface, this is done by providing extra insulation means, such as the bulkhead assembly with the peripheral gasket assembly, which implies additional manufacturing costs. Further, due to the requirement of removability of the refrigeration unit for maintenance or repair, the coupling of the insulating means could not always guarantee a perfect seal and, in any case, the problem of wear and tear due to friction occurring when slidably installing or removing the unit can cause a decrease of the sealing capacity of the insulating means.

A further drawback common to the prior art solutions mentioned above is that the evaporator is arranged substantially at the same horizontal level as the other components of the refrigeration unit; this kind of horizontally extending assembly is particularly advantageous if addressed to refrigeration units which have to be removable from the cabinet for maintenance or repair, because they can be easily slid into and out of the cabinet along a horizontal plane; however, this kind of assembly does not fit into conventional refrigerators, particularly those for household appliance, which generally mount the condensing assembly at the bottom and the evaporating assembly extending vertically along the back.

Therefore the refrigeration units known in the prior art can not be mounted in a cabinet of a conventional refrigerator, if this is not modified to house this kind of horizontally extending units.

Accordingly, the aim of the present invention is to provide a modular refrigeration unit for a refrigeration appliance, as well as a process for assembling the modular refrigeration unit to a cabinet of a refrigeration appliance, which overcomes the drawbacks and the limitations involved in the solutions known from the prior art.

Within the aim cited above, a purpose of the present invention is to provide a modular refrigeration unit which can be mounted on a conventional cabinet of a refrigeration appliance, in particular a refrigerator and/or a freezer for household appliance, requiring little or no modifications to the cabinet structure, such that the unit can be easily installed in an already existing production line of refrigerators and/or freezers.

Another purpose of the present invention is to provide a modular refrigeration unit and a process for assembling said unit to a cabinet of a refrigeration appliance wherein the insulation and the air-tight seal at the connecting interface between the unit and the cabinet is improved, thus avoiding any potential ice formations.

A further purpose of the present invention is to provide a modular refrigeration unit wherein the improved insulation is reached without any significant increase of the manufacturing costs.

A further and not less important purpose of the present invention is to provide a modular refrigeration unit capable of being manufactured by using generally known and readily available tools, machinery and equipments; similarly, a purpose of the present invention is to provide a process for assembling said unit to a cabinet capable of being carried out at competitive costs and by using generally known and readily available tools, machinery and equipments.

These aims and purposes are achieved by a modular refrigeration unit as defined in claim 1, and by a process for assembling a modular refrigeration unit to a cabinet of a refrigeration appliance as defined in claim 12.

Further features and advantages of the present invention may be readily understood from the following description of a preferred, although not sole, embodiment illustrated by way of a non-limiting example with reference to the accompanying drawings, in which.

Figure 8:
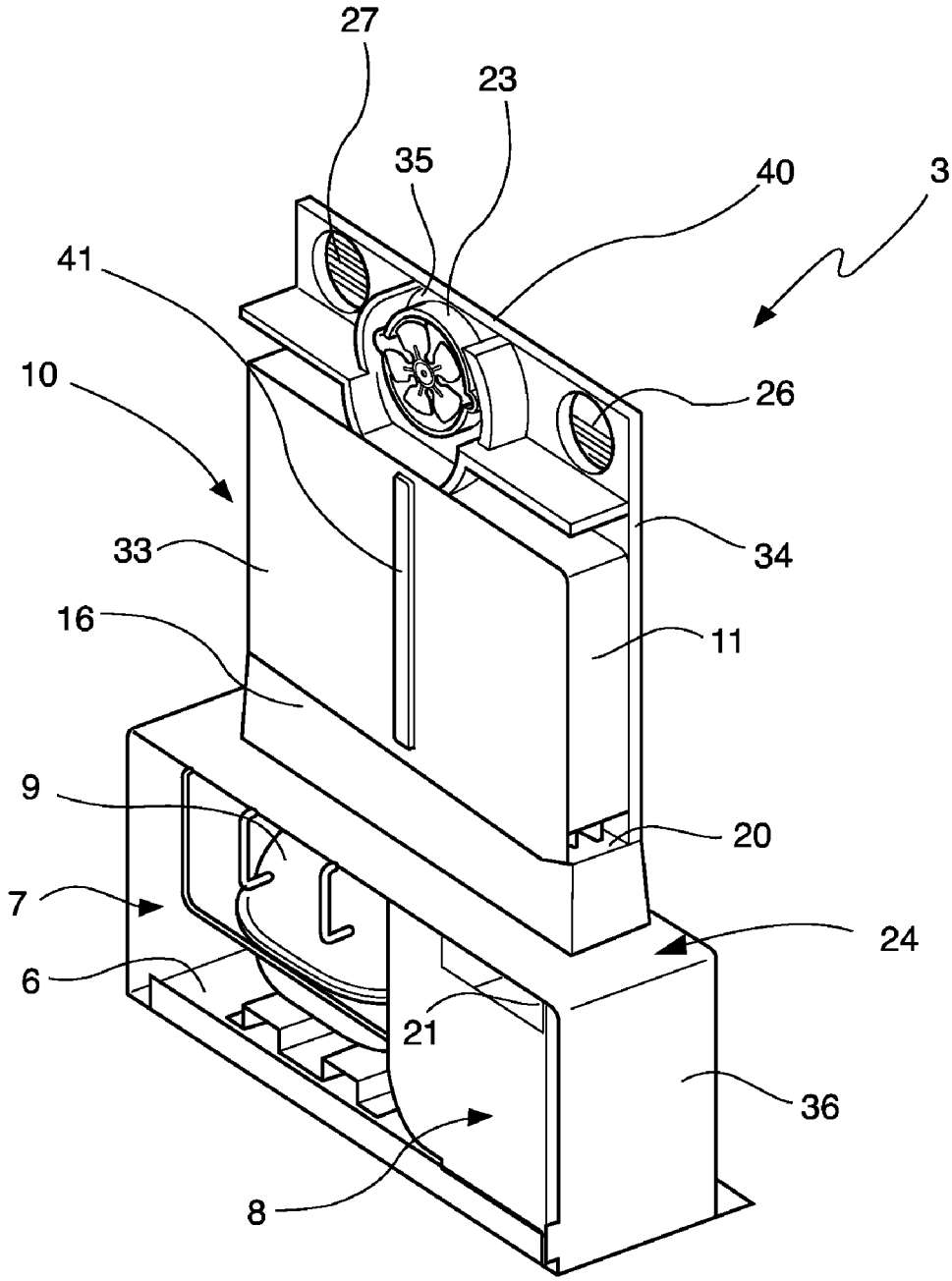
FIG. 8 shows the condensing assembly joined to the evaporating assembly to form the modular refrigeration unit according to the present invention.
Figure 8A:
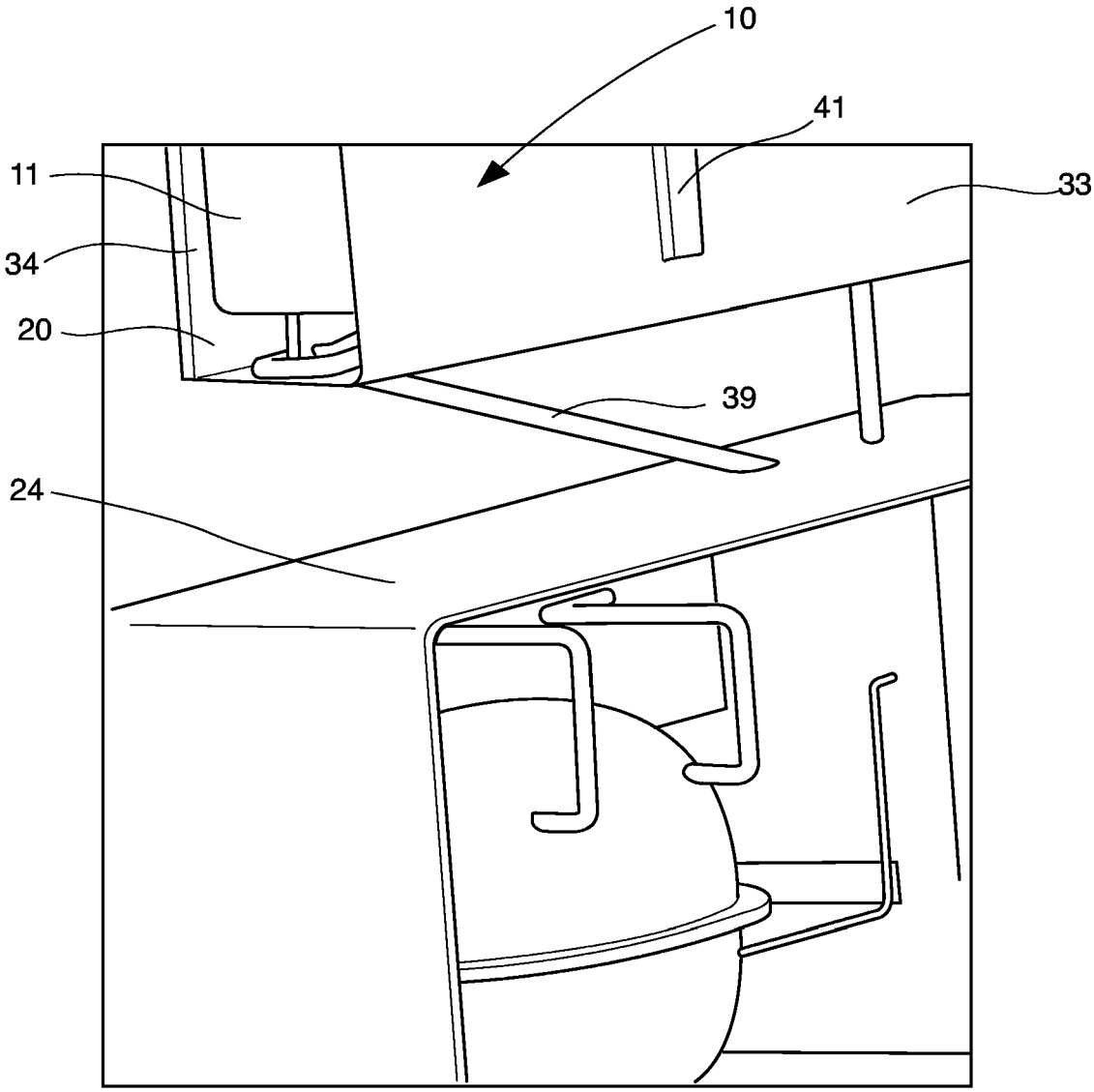
Figure 9:
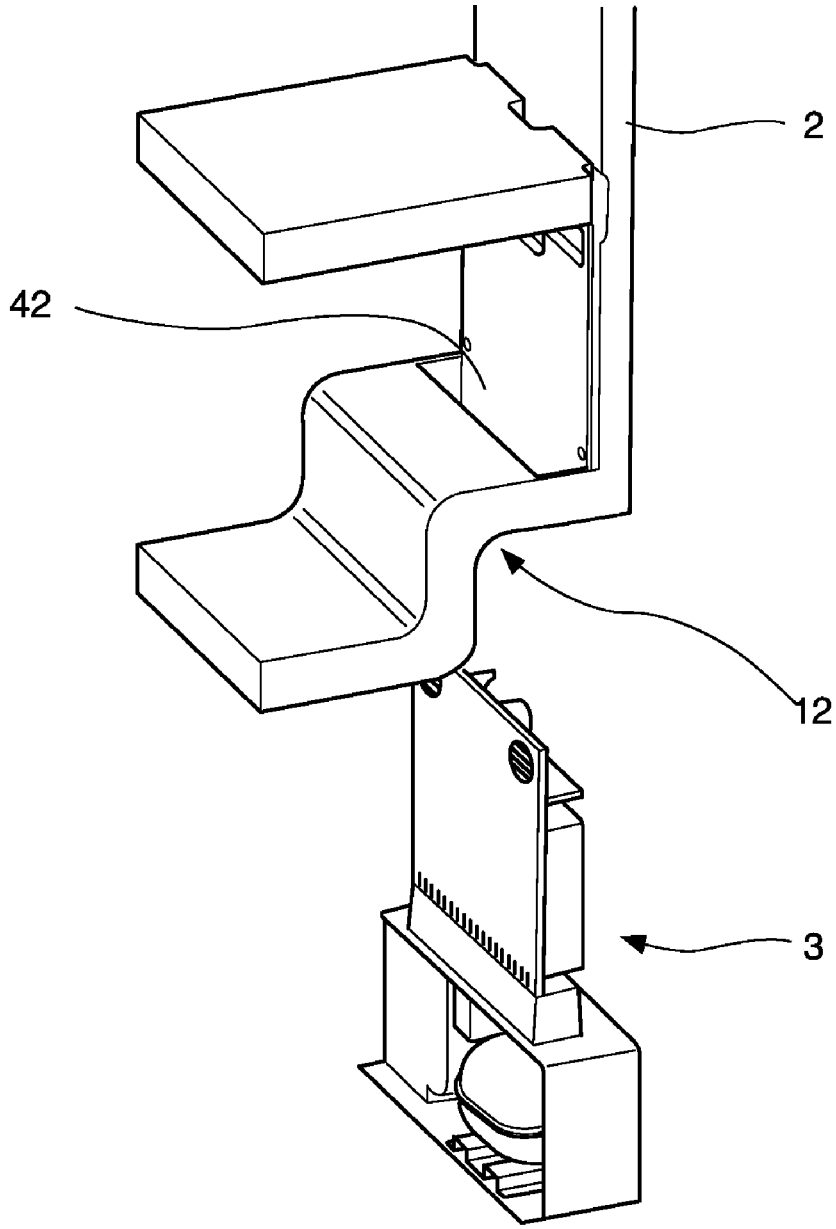
Figure 10:
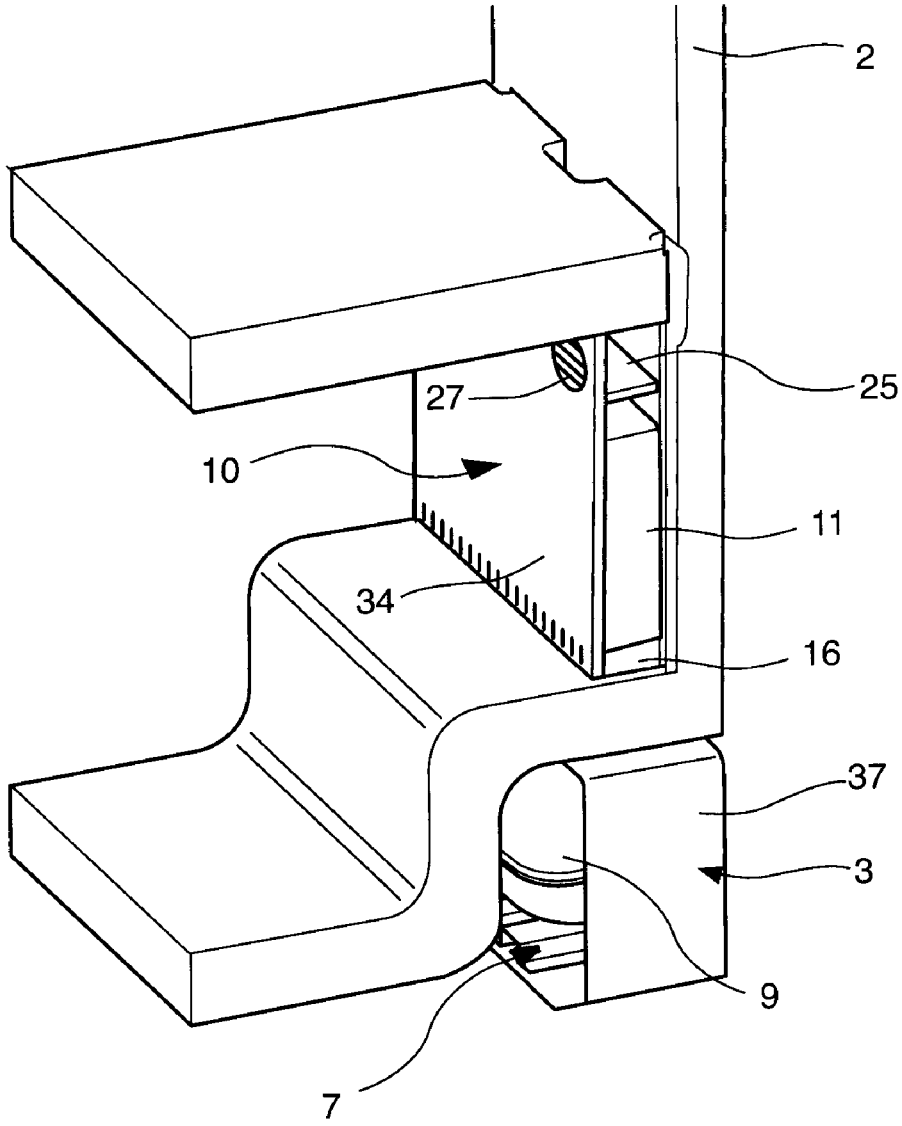
Figure 11:
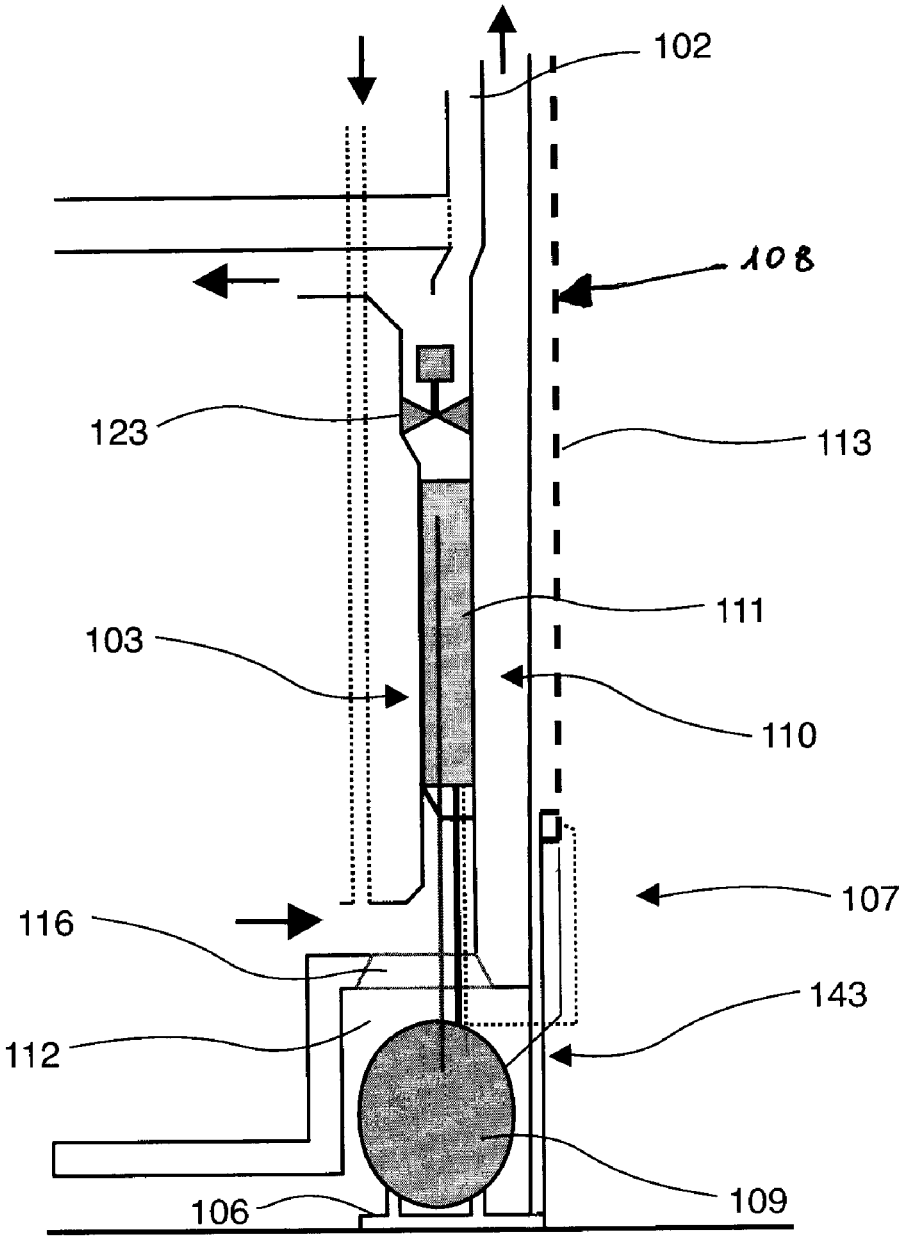

FIG. 8*a* is a particular of FIG. 8 showing the piping between the condensing and the evaporating assemblies;

FIG. 9 shows the modular refrigeration unit of FIG. 8 before assembling to a cabinet of a refrigeration appliance;

FIG. 10 shows the modular refrigeration unit of FIG. 9 assembled to the cabinet;

FIG. 11 shows a further embodiment of a modular refrigeration unit according to the present invention.

With reference to the above mentioned figures, a refrigeration appliance 1 includes an insulated cabinet 2 and a modular refrigeration unit 3; the cabinet 2 comprises one or more food storage compartments, such as a freezer compartment 4 and a refrigerator compartment 5. The modular refrigeration unit 3 includes a base plate 6 supporting a condensing assembly 7, which comprises condensing means 8 and a compressor 9, and an evaporating assembly 10 comprising an evaporator 11. The modular refrigeration unit 3 is mounted at the lower back portion of the cabinet 2, where a recess 12 in the cabinet 2 houses the condensing assembly 7, as it will be described more in detail below.

Figure 1:
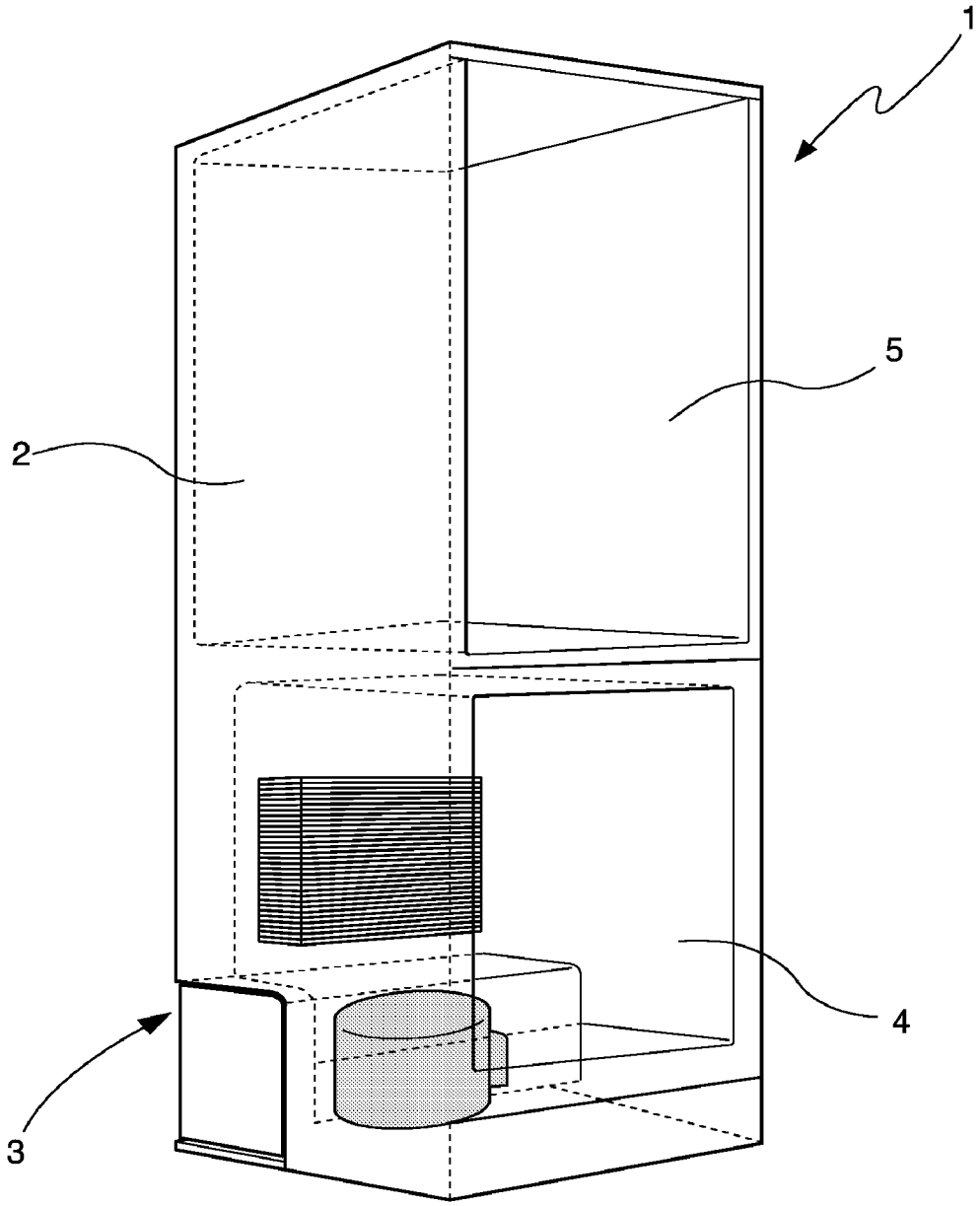
FIG. 1 is a perspective view of a refrigeration appliance including a modular refrigeration unit according to the present invention.
Figure 2:
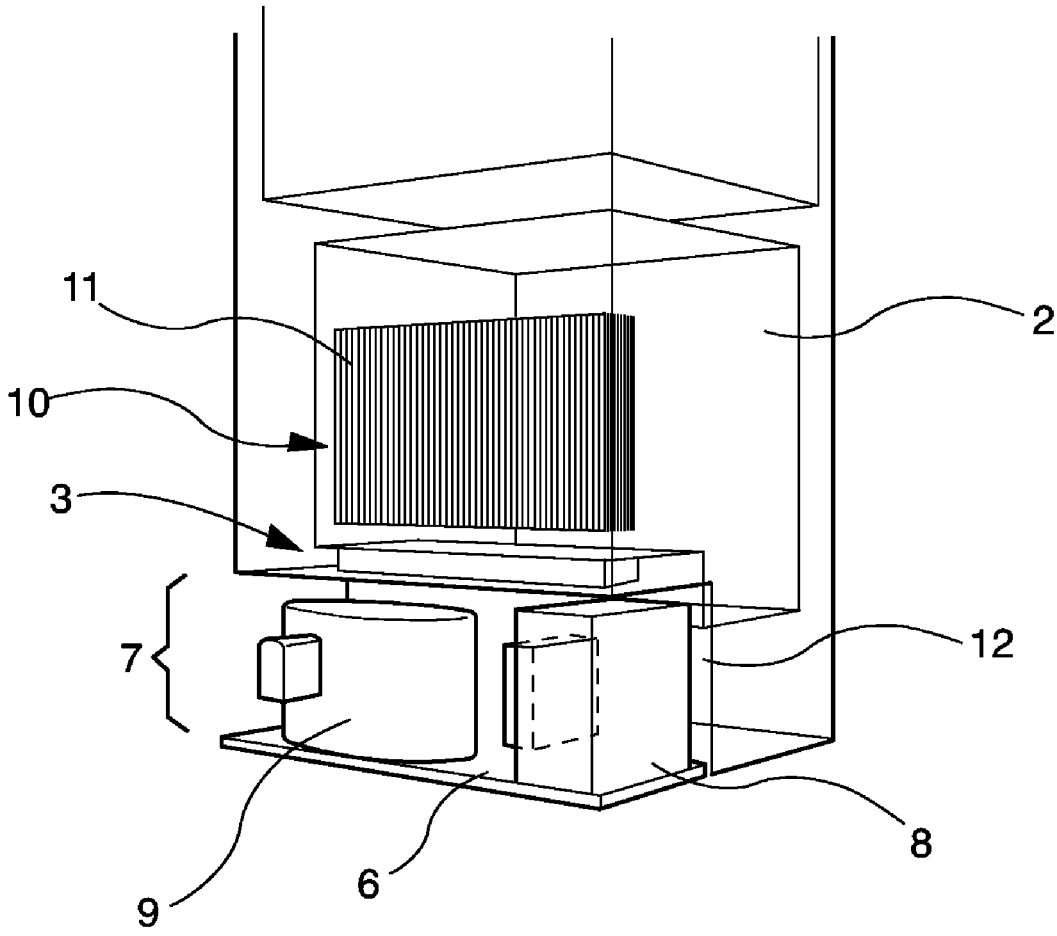
FIG. 2 is a perspective rear view of the lower portion of the refrigeration appliance of FIG. 1.
Figure 3:
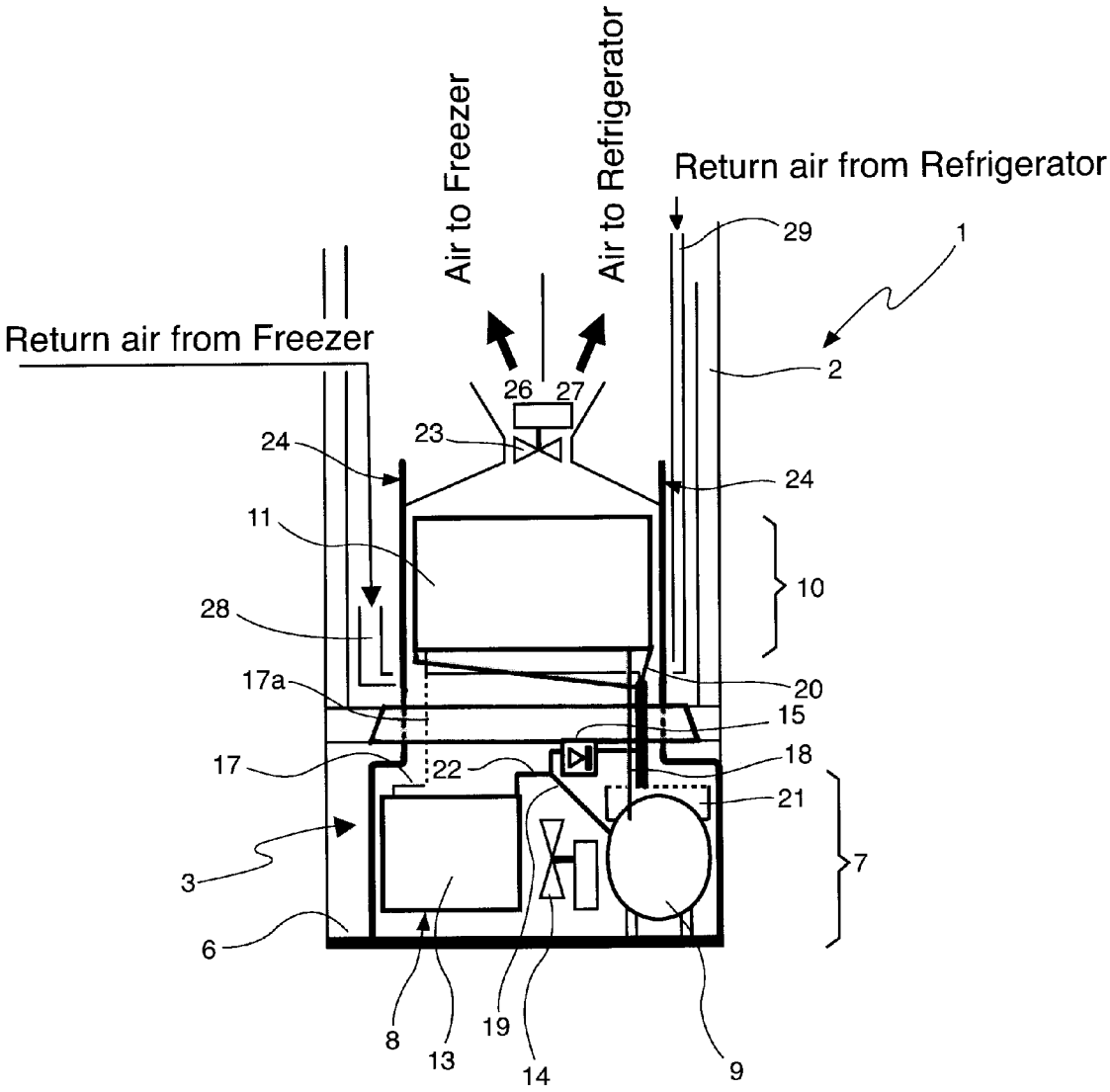
FIG. 3 is a schematic view of the back of a refrigeration appliance including a modular refrigeration unit according to the present invention.
Figure 4:
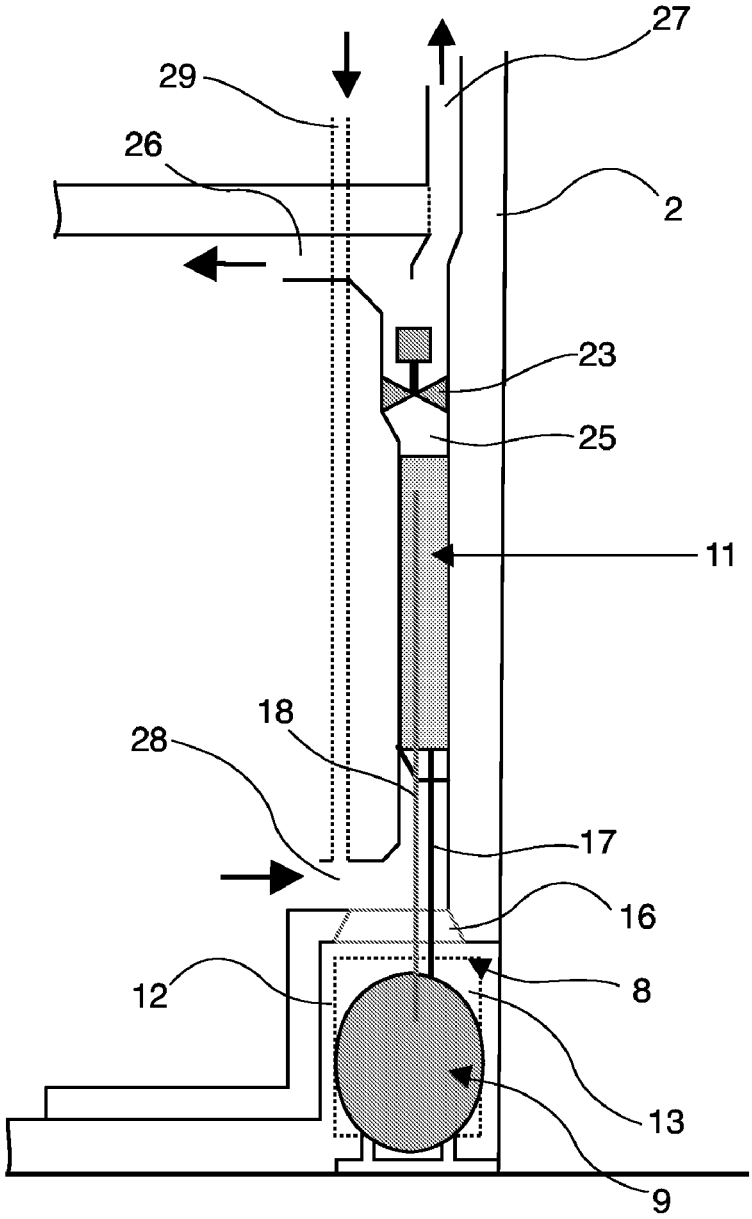
FIG. 4 is a schematic side view of the refrigeration appliance of FIG. 3.

FIGS. 3 and 4 show a functional scheme of a refrigeration appliance 1 provided with a modular refrigeration unit 3 having no-frost characteristics; in this case, the condensing assembly 7 includes a dynamic condenser 13 with a fan 14 and defrost means, such as a hot gas defrost line 22 with a valve 15 or an electric heater. Insulating means 16 separate and air-tight seal the condensing assembly 7 from the evaporating assembly 10. This latter is arranged in an evaporating chamber 25 at the back of the cabinet 2 above the condensing assembly 7, the evaporator 11 with an air circulation fan 23 being supported by support means 24 vertically extending from the base plate 6.

The dynamic condenser 13, the evaporator 11 and the compressor 9 are operatively connected through a conduit 17 including a capillary tube 17*a*, a suction line 18 and an output line 19, respectively. A defrost water collector 20 is arranged below the evaporator 11 to collect and convey defrost water to a water tray 21 arranged in the condensing assembly 7 above either the dynamic condenser 13 or the compressor 9.

The air cooled by the evaporator 11 in the evaporating chamber 25 is sent to the freezer compartment and the refrigerator compartment through respective outlet ducts 26, 27, and returned to the evaporating chamber 25 through respective inlet ducts 28, 29.

FIGS. 5 to 8 show the main components of the modular refrigeration unit according to the present invention and how they are assembled together to form the unit.

Figure 5:
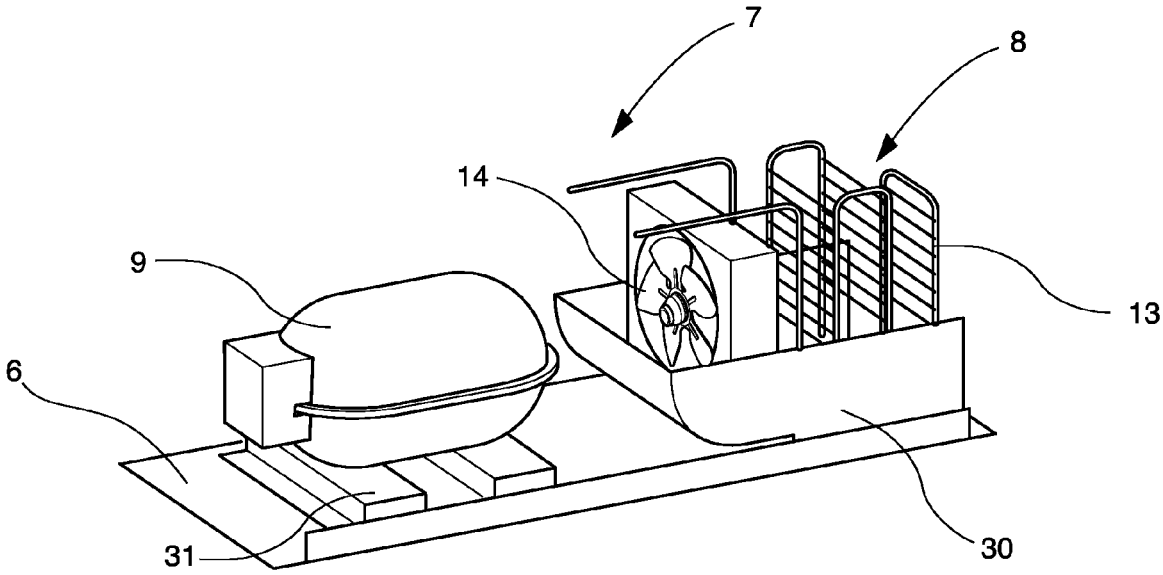
FIGS. 5 and 6 show the condensing assembly of a modular refrigeration unit according to the present invention.
Figure 6:
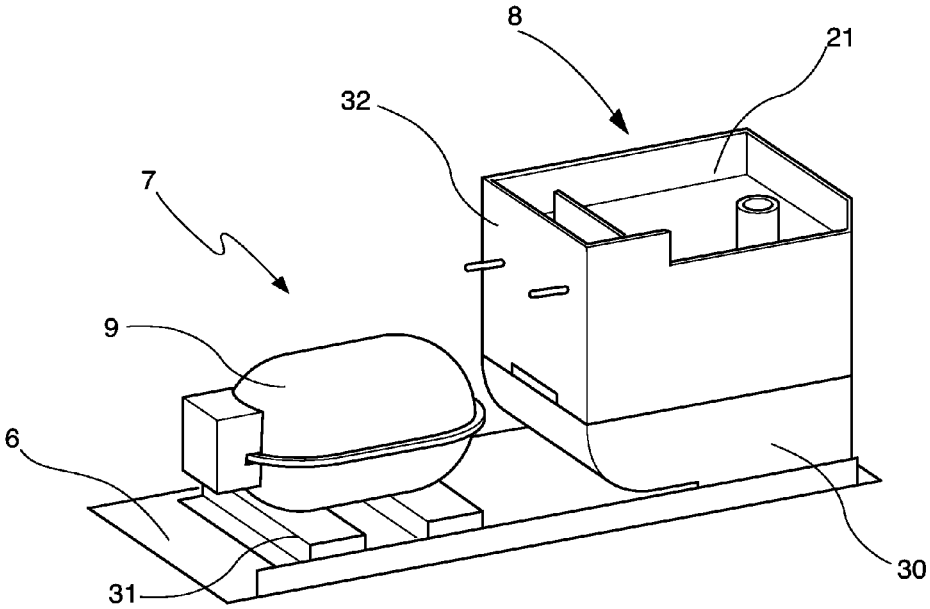

In FIGS. 5 and 6 the condensing assembly 7 supported by the base plate 6 is shown; as described above, the condensing assembly 7 includes condensing means 8 which comprise a dynamic condenser 13 and a fan 14 housed in a lower cover 30 attached to the base plate 6, and a compressor 9 attached to the base plate 6, preferably by the interposition of a shaped plate 31; the compressor 9 is arranged opposite the condensing means 8 and operatively connected to the dynamic condenser 13 through an output line, indicated with the numeral reference 19 in FIG. 3 but not shown in FIGS. 5 and 6.

The dynamic condenser 13 and the fan 14 are covered by an upper cover 32 which is provided at the top with a recess forming a water tray 21 for the defrost water coming from the defrost water collector 20 arranged below the evaporator 11, as it will be described more in detail below.

Figure 7:
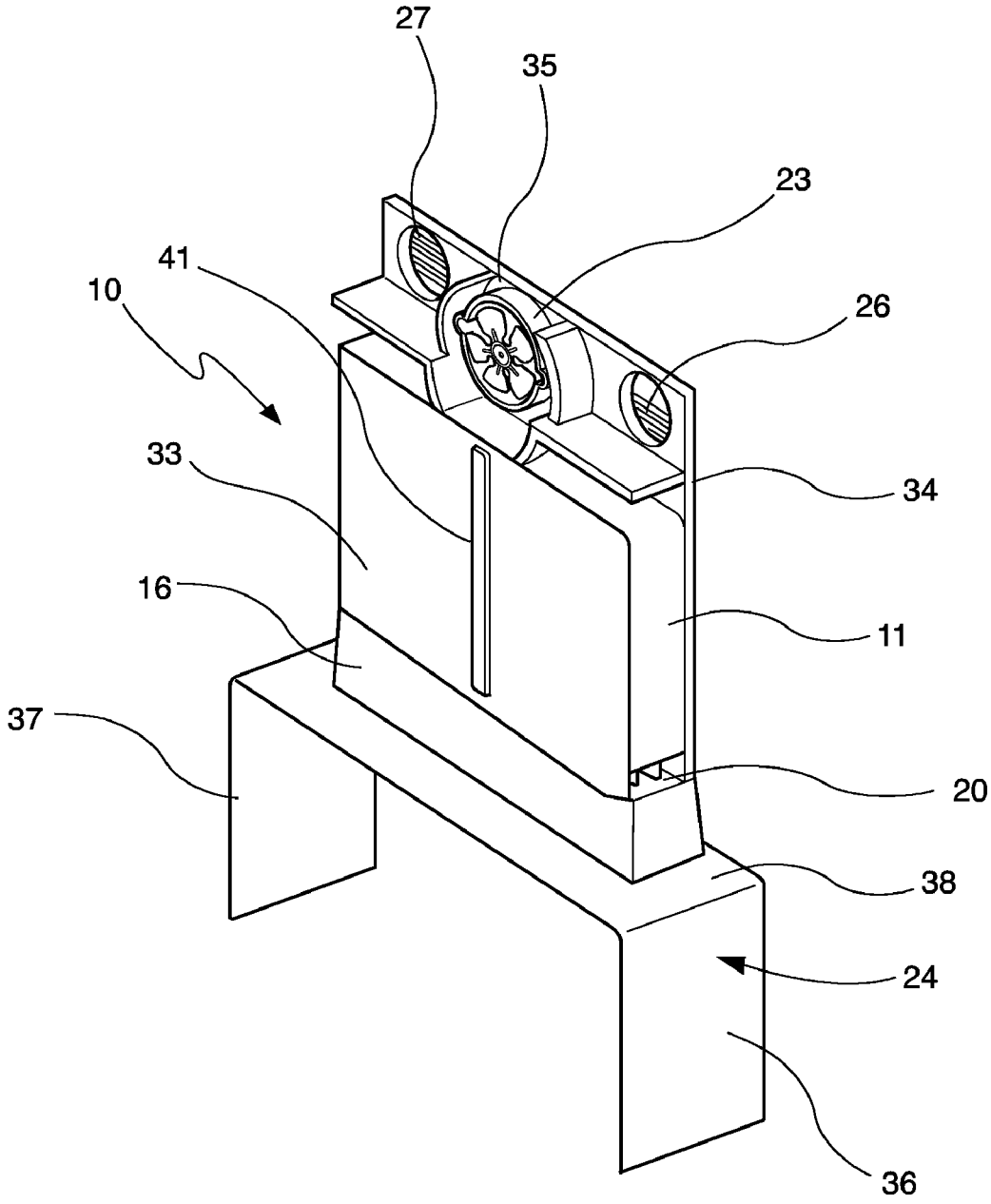
FIG. 7 shows the evaporating assembly of a modular refrigeration unit according to the present invention.

FIG. 7 shows the evaporating assembly 10, comprising the evaporator 11 attached to a back support plate 33, preferably made in aluminium; advantageously the back support plate 33 has a L- or U-shaped lower portion adapted to constitute the defrost water collector 20, in communication with the water tray 21 through an appropriate discharge pipe (not shown); a front plate 34 covering the front side of the evaporator 11 is provided with a housing 35 for the air circulation fan 23 and with outlets 26 and 27 to send cooled air to the freezer and refrigerator compartments.

Advantageously the housing 35 can serve also as a protective cover for the fan 23 during transportation. In a preferred embodiment, the fan 23 can move between a first stably position wherein it is completely contained into the housing 35, and a second stably position wherein it is extracted from the housing 35; the first position is maintained both during transportation and installation of the refrigeration modular unit 3 into the cabinet 2, while the fan 23 is moved to the second position once the modular unit 3 is in place into the cabinet.

The evaporating assembly 10 is supported by vertically extending support means 24, which are preferably formed by a bracket having two vertically extending side legs 36, 37 and a horizontal plate 38, with the interposition of insulating means 16 formed by a foamed piece which can be foamed directly between the lower portion of the back support plate 33 forming the water tray 21 and the horizontal plate 38 of the support means 24, such that the piping between the evaporating and condensing assemblies are foamed in and embedded with the foamed piece, this latter thus connecting the evaporating means 10 to the support means 24. Advantageously the foamed piece has a substantially truncated pyramid shape in order to facilitate the installation of the modular refrigeration unit in the cabinet, as well as to guarantee an optimal air-tight seal at the interface between the evaporating and condensing means.

Referring now to FIG. 8, the evaporating assembly 10 and the insulating means 16 formed as described above are attached to the base plate 6 through the vertically extending support means 24, such that the evaporating assembly is arranged above the condensing assembly 7; the structure of a modular refrigeration unit 3 according to the present invention is thus obtained. The piping are then interconnected, by welding or other suitable known processes, to the respective components in order to build up the refrigeration circuit, as well as appropriate valves and electronic control devices are provided in the circuit according to well established practice in the refrigeration field.

FIG. 8*a* shows a discharge pipe 39 for the defrost water extending from the defrost water collector 20 and in communication with the water tray 21 (not shown) above the condenser 13. The discharge pipe 39, as well as the other piping interposed between the evaporating means 10 and the support means 24, are embedded into the insulating foamed piece 16, not shown in FIG. 8*a* for the sake of clarity.

Advantageously, a front protective cover 40 can be attached to the front plate 34; further, the back support plate 33 can be provided with centering means, such as an outwardly projecting longitudinal rib 41.

The process for assembling the modular refrigeration unit 3 completed as described above to a cabinet 2 of a refrigeration appliance is shown in FIGS. 9 to 10, wherein a partial view of the rear lower section of the cabinet 2 is evidenced; the cabinet 2 is foamed for insulation and pre-wired for connection to the refrigeration modular unit 3. An aperture 42 having a generally rectangular section is provided at the upper portion of the recess 12. The modular refrigeration unit 3 is installed in the foamed pre-wired cabinet 2 from the bottom, the evaporating assembly 10 passing through the aperture 42 up to when the foamed piece 16 abuts, with its peripheral side surfaces, the corresponding peripheral side surfaces of the aperture 42. At this point the modular refrigeration unit 3 is installed into the cabinet 2, as shown in FIG. 10, with the evaporating assembly 10 vertically arranged close to the inner back side of the cabinet 2 so as to form the evaporating chamber 25, and the condensing assembly 7 housed in the recess 12 at the back lower portion of the cabinet 2; the two assemblies 7 and 10 are therefore both supported by the common base plate 6 and mutually insulated by the foamed piece 16 which sealingly closes the aperture 42.

The modular refrigeration unit 3 can be permanently connected to the cabinet 2 by, for example, adhesive means applied to the peripheral side surfaces of the aperture 42 which, when the corresponding side surfaces of the foamed piece 16 enter into contact during installation of the unit 3, permanently attach the foamed piece 16 to the cabinet.

Another suitable process is to install from the bottom, as described above, the unit 3 in a cabinet which has been pre-wired and foamed, and permanently attaching the unit 3 to the cabinet 2 by foaming in place the foamed piece 16.

A further suitable process for permanently attaching the modular refrigeration unit 3 to the cabinet 2 is to install the unit 3 from the bottom, as described above, in a cabinet which has been pre-wired but not foamed; once the modular refrigeration unit 3 in installed in place into the cabinet, foaming of the whole assembly so obtained is performed such that the modular refrigeration unit 3 is permanently incorporated into the cabinet 2.

It is understood that any other suitable connecting processes can be adopted, such as a mechanical connection by fastening means, e.g. screws, even though a mechanical connection can result less safe for the air-tight sealing at the interface between the evaporating and condensing assemblies.

In order to facilitate the installation of the modular refrigeration unit 3 into the cabinet 2, the centering means at the back of the support plate 33, preferably constituted by the outwardly projecting longitudinal rib 41, can engage with corresponding guide means, such as a groove (not shown), provided at the inner surface of the back of the cabinet 2. Additionally, or alternatively, guide means formed by grooves (not shown) on the inner sidewalls of the cabinet 2 facing the refrigeration modular unit 3, when in place, can be provided in order to increase the precise positioning of the evaporator 11 during mounting of the unit 3, as well as its holding in place.

A further embodiment of a modular refrigeration unit according to the present invention is shown in FIG. 11, wherein a static condenser is provided: a condensing assembly 107 includes a compressor 109 mounted on a base plate 106, and an additional support means 142, such as a rod, vertically extending from the base 106 and adapted to support condensing means 108 including a static condenser 113 at the outside of the back of a cabinet 102; an evaporating assembly 110, including an evaporator 111 and an air circulation fan 123, is arranged above the condensing assembly 107, namely above the compressor 109, as already described with reference to the embodiment of FIGS. 5 to 10. Insulating means 116, formed by a foamed piece, separate and air-tight seal the evaporating assembly 110 from the condensing assembly 107.

From the above description it has been demonstrated how the modular refrigeration unit according to the present invention, as well as the process for assembling a modular refrigeration unit to a cabinet of a refrigeration appliance according to the present invention, achieve the aims and purposes mentioned above: in fact, the mounting of a modular refrigeration unit on a conventional cabinet of a refrigeration appliance, in particular a refrigerator and/or a freezer for household appliance, requires little or no modifications to the cabinet structure because of the vertical arrangement of the evaporating assembly at the inner back side of the cabinet; this is in fact the conventional arrangement in a known refrigerator having separately assembled components. Thus the modular refrigeration unit can be readily and easily installed in an already existing production line of cabinets for refrigerators and/or freezers.

Another advantage of the present invention is that the insulation and the air-tight seal at the connecting interface between the modular refrigeration unit and the cabinet is improved, thus avoiding any potential ice formations, without any substantial increase of the overall cost required by an extra insulation; this is reached thanks to the abutment of the foamed piece 16, either integral with the unit 3 or foamed in place, with the aperture 42, which provides an effective insulation both at the interface between the cabinet 2 and the unit 3 and between the condensing assembly 7 and the evaporating assembly 10.

The preferred use of support means 24 formed by a bracket, to which the insulating means 16 are attached and which goes over the condensing assembly 7, gives additional stability to the refrigeration modular unit 3 and geometrical precision for its installing into the cabinet 2.

It will be readily appreciated that the modular refrigeration unit described above by mere way of example may be the subject of a number of modifications and different embodiments without departing from the scope of the present invention.

It should further be noticed that the materials used, as well as the shape and dimension of the individual component parts, may be the most appropriate according to the desired requirement, without this implying any departure from the scope of the present invention.

The invention claimed is:

1. Modular refrigeration unit for a refrigeration appliance, including a base plate (6, 106) supporting a condensing assembly (7, 107) comprising mean (8, 108) and a compressor (9, 109), and an evaporating assembly (10, 110) comprising an evaporator (11, 111), said condensing assembly and evaporating assembly being operatively interconnected, said evaporating assembly (10, 110) being arranged vertically spaced apart and right above said compressor (9, 109), said evaporating assembly being supported by support means (24) vertically extending from said base plate (6, 106) over said compressor (9, 109), insulating means (16, 116) formed by a foamed piece associated to said support means (24) being provided to said evaporating assembly (10, 110) from said condensing assembly (7, 107), characterized in that said foamed piece has a substantially truncated pyramid shape.

2. Modular refrigeration unit as in claim 1, wherein said insulating means (16, 116) are supported by said support mean (24) and are arranged between said condensing assembly (7, 107) and said evaporating assembly 10, 110).

3. Modular refrigeration unit as in claim 1, wherein said condensing mean (8) comprise a dynamic condenser (13), said compressor (9) and said dynamic condenser (13) being mounted on said base plate (6), said evaporating assembling (10) being arranged, in use, vertically spaced apart and above said compressor (9) and said dynamic condenser.

4. Modular refrigeration unit as in claim 1, wherein said support means (24) if formed by a bracket having at least two legs (36, 37) supported by, and vertically extending from, said base plate (6, 106), and a horizontal plate (38) arranged above said compressor (9) and connecting said legs (36, 37), said insulating means (16) being interposed between said horizontal plate (38) and said evaporating means (10) and being adapted to connect said evaporating assembly (10) to said support means (24).

5. Modular refrigeration unit as in claim 1, wherein said evaporating assembly (10) comprises an evaporator (11) attached to a back support plate (33) and to a front plate (34).

6. Modular refrigeration unit as in claim 5, wherein the lower portion of said back support plate (33) is shaped so as to constitute a defrost water collector (2) n communication with a water tray (21) associated to said condensing assembly (7).

7. Modular refrigeration unit as in claim 5, wherein said back support plate (33) is provided with centering means (41).

8. Modular refrigeration unit as in claim 5, wherein said front plate (34) is provided with a housing (35) for an air circulation fan (23) adapted to circulate air cooled from said evaporator.

9. Modular refrigeration unit as in claim 1, wherein said condensing means (108) comprise a static condenser (113), said compressor (109) being mounted on said base plate (106), said static condenser (113) being arranged at a side of said evaporating assembly (110) and being supported by additional support means (143) vertically extending from said base plate (106).

10. A process for assembling a modular refrigeration unit to a cabinet of a refrigeration appliance, said modular refrigeration unit including a base plate (6, 106) supporting a condensing assembly (7, 107) comprising condensing means (8, 108) and a compressor (9, 109), and an evaporating assembly (10, 110) comprising an evaporator (11, 111), said condensing assembly and evaporating assembly being interconnected, said evaporating assembly being supported by support means (24) vertically extending from said base plate (6, 106), insulating means (16, 116) being provided to separate said evaporating assembly (10, 110) from said condensing assembly (7, 107), said (2, 102) having a recess (12, 112) at the lower back portion adapted to house said condensing assembly (7, 107), characterized by the steps of:

providing said cabinet (2, 102) with an aperture (42) at the upper portion of said recess (12, 112)

installing said modular refrigeration unit (3, 103) into said cabinet (2, 102) form the bottom, passing said evaporating assembly (10, 110) through said aperture (42)

permanently connecting said modular unit (3, 103) to said cabinet (2, 102) by engaging the peripheral side surfaces of said insulating means (16, 116) with the peripheral side of said aperture.

11. A process as in claim 10, wherein said permanent connection between said modular refrigeration unit (3, 103) and said cabinet (2, 102) is obtained by gluing said insulating means (16, 116) to the peripheral side surfaces of said aperture (42).

12. A process as in claim 10, wherein said permanent connection between said modular refrigeration unit (3, 103) and said cabinet (2, 102) is obtained by foaming said insulating means (16, 116) into said aperture.

13. A process as in claim 12, wherein said permanent connection is obtained during overall foaming of said cabinet (2, 102).

14. A process as in claim 10, wherein during said step of installing said modular refrigeration unit (3, 103) into said cabinet (2, 102), centering means (41) provided on said evaporating assembly (10, 110) engage with corresponding guide means provided at one or more of the inner walls of said cabinet (2).

15. A refrigeration appliance comprising a cabinet (2, 102) and a modular refrigeration unit including a case pate (6, 106) supporting a condensing assembly (7, 107) comprising condensing means (8, 108) and a compressor (9, 109), and an evaporating assembly (10, 110) comprising an evaporator (11, 111), said condensing assembly and evaporating assembly being operatively interconnected, said evaporating assembly (10, 110) being arranged vertically spaced apart and above said compressor (9, 109), said evaporating assembly being supported by support means (24) vertically extending form said base plate (6, 106), insulating means (16, 116) being provided to separate said evaporating assembly (10, 110) from said condensing assembly (7, 107), characterized in that said cabinet (2, 102) has a recess (12, 112) arranged at the lower back portion of said cabinet (2, 102) and adapted to house said condensing assembly (7, 107), the upper portion of said recess (12, 112) being provided with an aperture (42) having peripheral side surface adapted to engage with said insulating means (16, 116), said aperture (42) being adapted to allow said evaporating assembly (10, 110 passing though into said cabinet to vertically arranged adjacent the inner back side od said cabinet.

* * * * *